US006629609B2

(12) United States Patent
Cook et al.

(10) Patent No.: US 6,629,609 B2
(45) Date of Patent: Oct. 7, 2003

(54) CONTAINER WITH HOLDER FOR ELONGATE ARTICLE

(75) Inventors: Martin Cook, Feltham (GB); Jane Wickstead, London (GB); David Wickstead, London (GB)

(73) Assignee: Super-Max Limited, Middlesex (GB)

( * ) Notice: Subject to any disclaimer, the term of this patent is extended or adjusted under 35 U.S.C. 154(b) by 0 days.

(21) Appl. No.: 09/899,177

(22) Filed: Jul. 6, 2001

(65) Prior Publication Data

US 2002/0005372 A1 Jan. 17, 2002

(30) Foreign Application Priority Data

Jul. 11, 2000 (GB) ..... 0017059

(51) Int. Cl.[7] ..... B65D 23/12

(52) U.S. Cl. ..... 206/734; 206/730; 206/362.4; 206/353

(58) Field of Search ..... 206/234, 353, 206/362.4, 730, 733, 734, 779, 780; 229/401

(56) References Cited

U.S. PATENT DOCUMENTS

| | | | | | |
|---|---|---|---|---|---|
| 1,217,375 | A | * | 2/1917 | Warren | 206/733 |
| 4,032,005 | A | * | 6/1977 | Vereb | 206/777 |
| 4,513,862 | A | | 4/1985 | Mallow | |
| 4,957,202 | A | * | 9/1990 | Yoshiki et al. | 206/734 |
| 4,993,845 | A | * | 2/1991 | Faltynek | 383/40 |

FOREIGN PATENT DOCUMENTS

| | | |
|---|---|---|
| GB | 340653 | 1/1931 |
| GB | 825586 | 12/1959 |
| GB | 956353 | 9/1960 |

* cited by examiner

*Primary Examiner*—David T. Fidei
(74) *Attorney, Agent, or Firm*—Nixon & Vanderhye P.C.

(57) ABSTRACT

A combination of a container and an elongate member in which a side panel of the container is provided with a plurality of lines of weakness. The plurality of lines of weakness can be bent into braces or a brace and a pocket. The combination of the brace and pocket can support and hold the elongate member relative to the container. The elongate member can easily be removed from the container with one hand.

22 Claims, 3 Drawing Sheets

CONTAINER WITH HOLDER FOR ELONGATE ARTICLE

BACKGROUND OF THE INVENTION

The present invention relates to containers. More particularly, the invention relates to containers for elongate articles such as disposable razors.

Containers of the prior art have typically been manufactured from a single sheet which is cut and bent into a container.

GB 340,653 discloses a box for matches and cigarettes. The box is a metal box in which two braces are formed in a side wall. The braces are dimensioned to permit a strip of abrasive material suitable for use as a nail file to be passed through the slits and held tightly in position. The braces are designed to hold the abrasive material tightly and the abrasive material cannot easily be removed from the box such that finger nails may be groomed without removing the nail file from the box.

SUMMARY OF INVENTION

A first aspect the present invention provides a combination of a container and an elongate member. The container includes a side panel provided with a plurality of lines of weakness for enabling a pocket and a brace to be formed. The lines of weakness are dimensioned such that, when formed, the pocket can support the elongate member at an end and the brace can loosely hold the elongate member at a medial portion. Thereby the elongate member is located relative to the container and the elongate member can easily be removed from the pocket and brace with one hand.

In this way, articles can be attached to the outside of the container, whilst other articles are still contained within the container, without the need for using more material than prior art containers. The container may be dimensioned for containing disposable razors, preferably up to about half a dozen, and the lines of weakness may be dimensioned such that the handle of a disposable razor may be loosely held by the pocket and brace. The container of the present invention advantageously allows a razor which has been used, to be separated from unused razors in the container, by being attached to the outside of the container in an easily accessible way.

If the elongate member is a handle of a razor then the advantage of the elongate member being loosely held such that it can be removed from the pocket and brace with one hand is that the user, if they have shaving foam over their hands, need not dirty the container with shaving foam because it is not necessary to hold the container in order to remove the razor.

Another advantage of the hereinafter described embodiment is that shaving debris left on the razor after use will run down the elongate handle of the razor and into the pocket formed in the container. In this way the shaving debris which might include soap and bits of hair, are prevented from dirtying the surface on which the container is placed.

A second aspect the present invention further provides a combination of a container and a razor. The razor comprises an elongate handle and a head and the container includes a side panel with at least three substantially parallel lines of weakness. These enable a first brace and a second brace to be formed. The lines of weakness are dimensioned such that when formed, the first brace supports the razor by the head and the first and second braces loosely hold the elongate handle at a medial portion. Thereby the razor is located relative to the container and the razor can easily be removed from said first and second brace with one and.

A third aspect the present invention further provides a method comprising the steps of: forming two substantially parallel lines of weakness in a side panel of a container; and providing instructions to bend the side panel between the two lines of weakness outwards to form a brace and to insert an elongate handle of a razor between the brace and the side panel.

The present invention will now be described by way of example only with reference to the accompanying drawings in which:

DETAILED DESCRIPTION OF THE PREFERRED EMBODIMENTS

In the various drawings, like parts are identified by like references.

Figure 1:
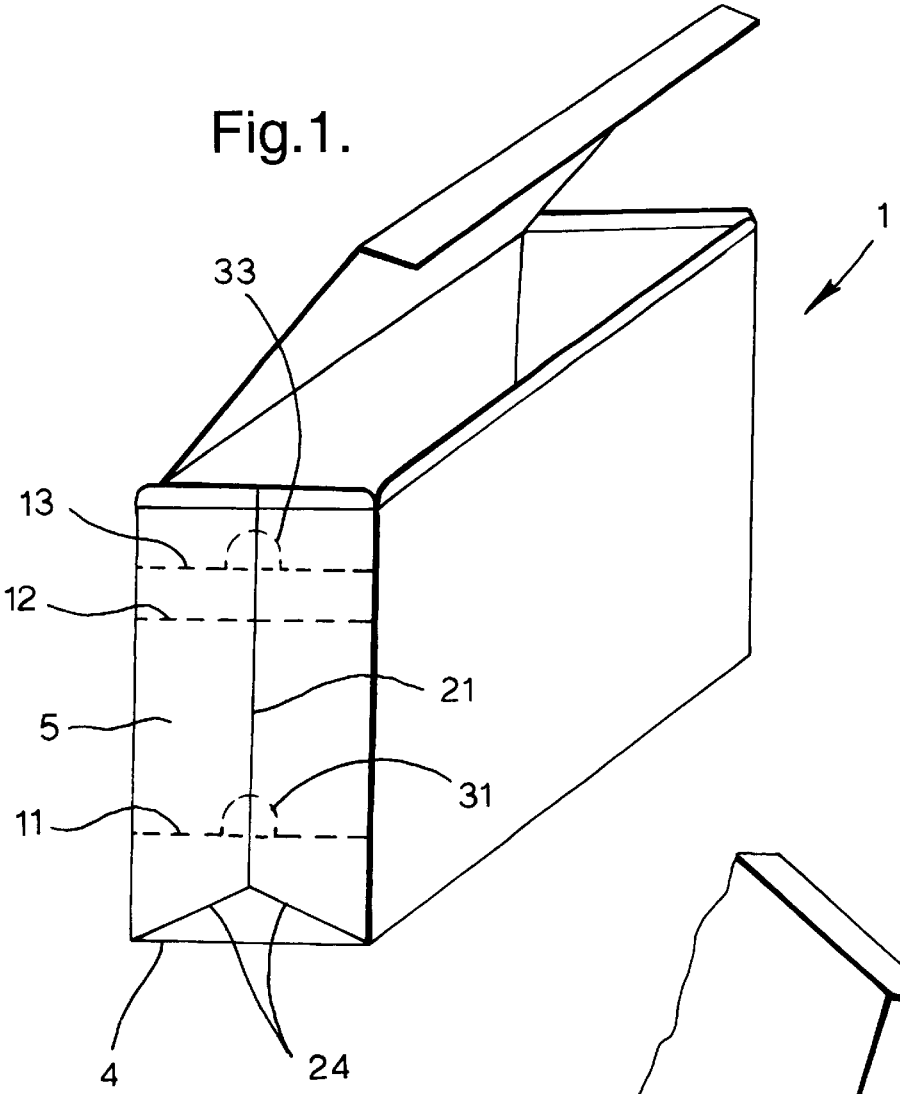
FIG. 1 shows a container according to the first embodiment of the present invention before manipulation to form a holder.
Figure 2:
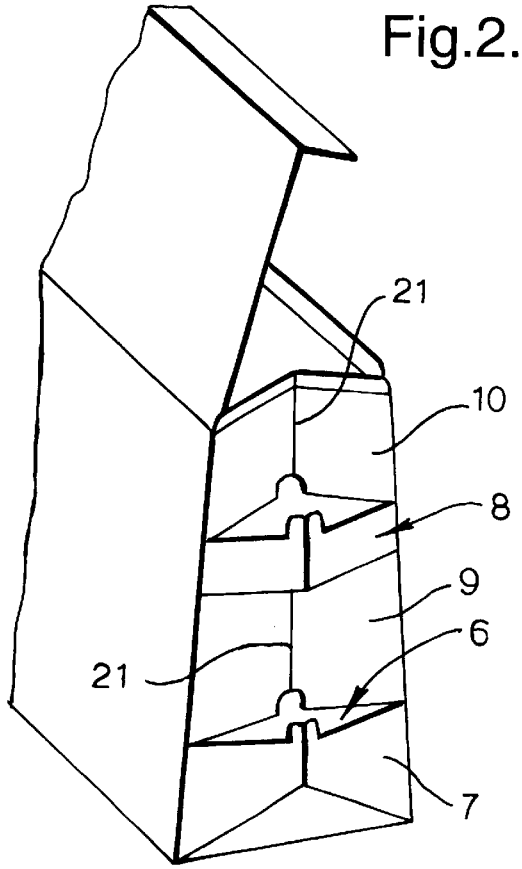
FIG. 2 shows a container according to the first embodiment of the present invention after manipulation to form a holder.

FIG. 1 shows a container 1 according to the present invention. One side panel 5 of the container (which is preferably made of a plastics material) has a first line of weakness 11 adjacent a bottom end 4 of the side panel 5. The line of weakness 11 is generally parallel to the bottom end 4 of the side panel and extends substantially all the way across the side panel 5. The bottom end 4 of the side panel is closed by the container. A pocket 6 as depicted in FIG. 2 can be formed by breaking the side panel 5 along the first line of weakness 11 and pulling outwards the portion 7 of the side panel between the first end 4 and the first line of weakness 11 and pushing inwardly the portion 9 of the side panel 5 on the other side of the first line of weakness.

Figure 5:
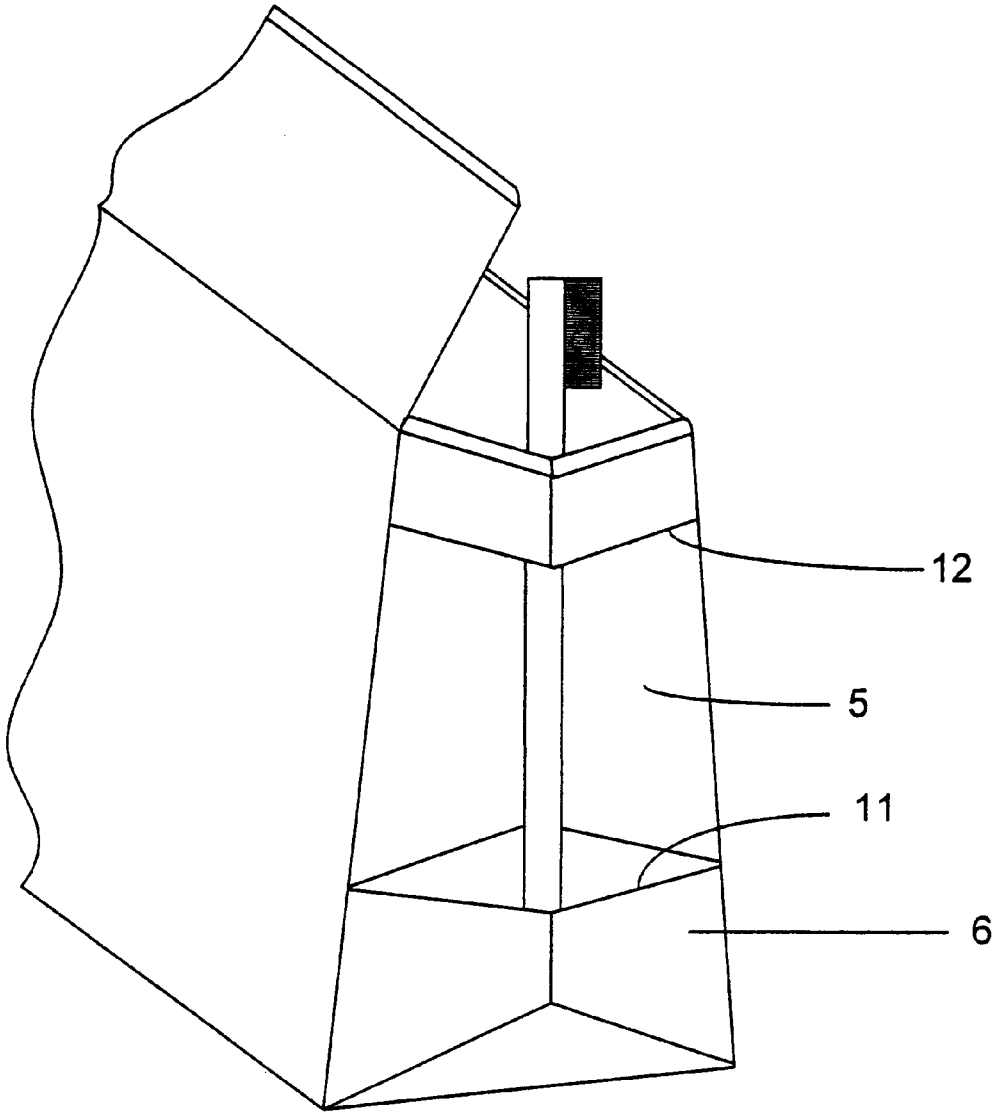
FIG. 5 shows a container of the present invention supporting a toothbrush.

The side panel 5 contains a second line of weakness 12 which extends substantially all the way across the side panel 5. A brace is formed by breaking the side panel 5 along the line of weakness 12 and by bending the top part of the side panel, above the second line of weakness, outwardly. (See also FIG. 5, showing the container supporting a toothbrush.) In the embodiment shown in the figures, a third line of weakness 13 extending substantially all the way across the side panel 5 is also present to allow a brace 8 to be bent outwards and a top part 10 of the side panel 5 to be bent inwards. This is the preferred arrangement, but the invention works even if only the first line of weakness 11 and the second line of weakness 12 are present.

Figure 3:
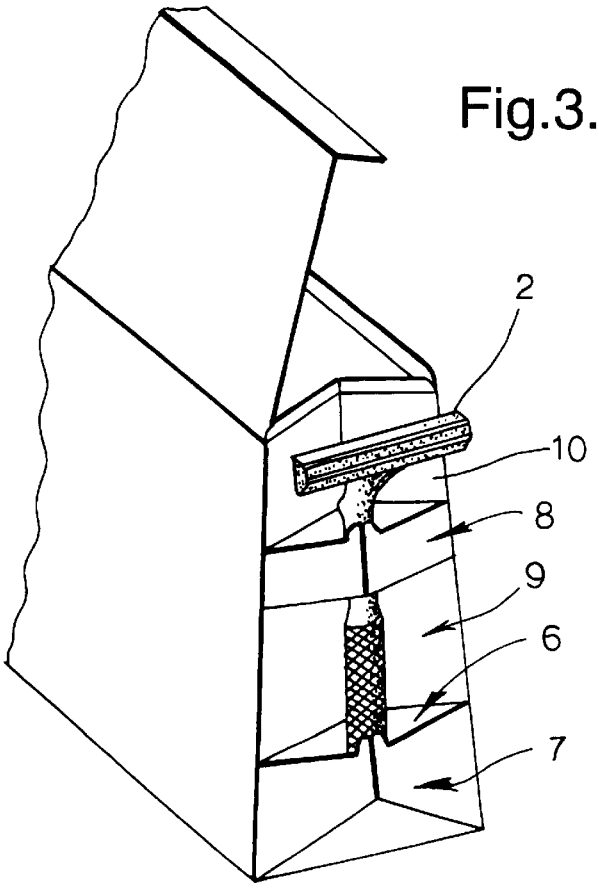
FIG. 3 shows a container according to the first embodiment of the present invention and an elongate member held on the outside of the container after manipulation of the container.

As is shown in FIG. 3 an elongate article 2 may be held on the side panel 5 of the container by inserting an end of the elongate article 2 through the brace 8 and into the pocket 6 such that the brace surrounds a medial portion of the elongate article.

Preferably the article can be lifted away from the first end 4 of the side panel 5 by one hand more preferably without the need to support the container. This is arranged by ensuring that the dimensions of the plurality of lines of weakness are such that the brace only loosely holds the elongate member and that the pocket only supports the elongate member. Preferably the elongate member can be lifted away from the container without needing to support the container in any other way. Typically this would result in one relative position of razor to container in which only the bottom end of the razor touches the container inside the pocket and the medial portion of the razor does not actually touch the brace or side panel. If the container is turned upside down the pocket cannot support, and the brace cannot hold the elongate member against the force of gravity.

The elongate article may be a razor comprising an elongate handle and a head. The elongate article may be any other toiletry product such as toothpaste or a toothbrush and the container may be dimensioned to contain any number of toiletry products. The container may even hold liquids such as shaving foam or shower gel.

Optionally, the pocket 6 and/or brace 8 may be formed of material stuck onto the side panel 5.

The first 11, second 12, and third 13 lines of weakness may be formed as perforations, may be scored or may be cut such that the side panel 5 is easy to pull apart at the lines of weakness.

In order to aid bending of the side panel 5, creases 21, 24 are preferably manufactured into side panel 5 to allow the side panel 5 to be easily bent along the creases.

Creases 24 run from the corners of the first end 4 of the side panel 5 to meet at the middle of the side panel 5 below the first line of weakness 11. A further crease 21 running from the point at which creases 24 intersect along the middle of the side panel 5 to the end opposite the first end 4 runs generally perpendicularly through the first, second and third lines of weakness. The first, second and third lines of weakness are preferably generally parallel to one another and are preferably along the whole width of the side panel 5.

In order to help the user to pull the bottom part 7 outwardly, a tab shape 31 is formed in first line of weakness 1. Similarly, in the preferred embodiment, a tab 33 is formed on the third line of weakness 13. If only the first and second lines of weakness are present, a tab can be formed below the first line of weakness 12.

Preferably, the container of the present invention is manufactured from a single sheet of material which is cut to shape prior to being bent into a container shape and glued at overlaps to form the container.

Preferably instructions are printed on the container describing to the user how to form the various pockets and/or braces.

Figure 4:
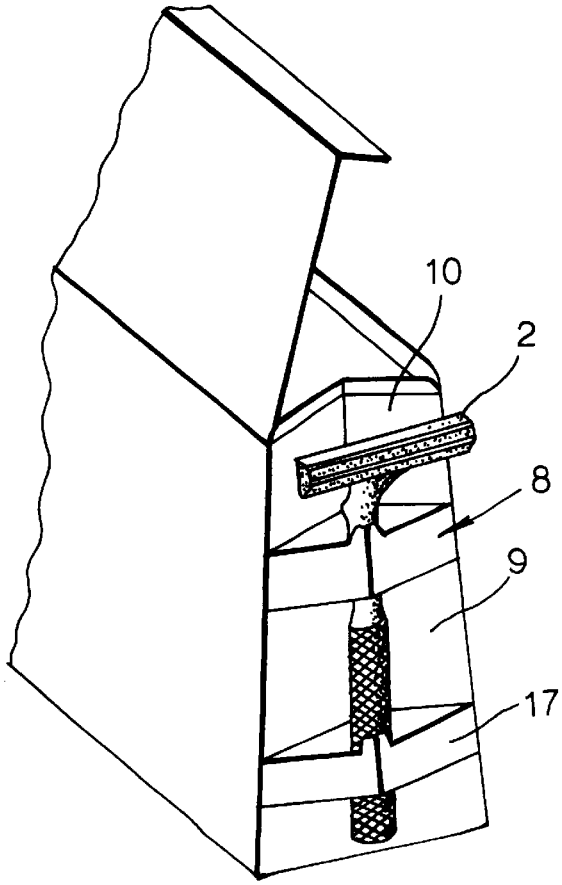
FIG. 4 shows a container according to the second embodiment of the present invention.

FIG. 4 shows a second embodiment of the present invention in which four lines of weakness can be bent to form a first brace 8 and a second brace 17. The first and second braces 8, 17 both surround medial portions of the elongate member and the first brace 8 also supports the head 2 of the razor. Of course, as in the first aspect of the present invention, the first brace 8 may be formed by only one line of weakness. The plurality of lines of weakness are dimensioned such that the razor can be removed from the container with one hand as in the first embodiment described earlier. The same constructional details and dimensions as described above in relation to the first embodiment apply equally to the second embodiment.

It is to be understood that the invention is not limited to the exact construction illustrated and described above, but that various changes and modifications may be made without departing from the spirit and scope of the invention.

We claim:

1. A combination of a container and an elongate member, said container including a side panel with an inner face and an outer face and provided with a plurality of lines of weakness or cuts for enabling a pocket and a brace to be formed, said container and lines of weakness or cuts being dimensioned such that, when formed, said pocket can support said elongate member at an end and said brace can loosely hold said elongate member at a medial portion thereby to locate said elongate member relative to said container and such that said elongate member is located adjacent said inner face at said medial portion and said end and adjacent said outer face between said medial portion and said end and said elongate member can easily be removed from said pocket and brace with one hand.

2. A combination of a container and an elongate member according to claim 1, wherein said lines of weakness or cuts are dimensioned such that said elongate member can be removed from said pocket and brace without supporting said container.

3. A combination of a container and an elongate member according to claim 1, wherein said lines of weakness or cuts are dimensioned such that said elongate member can be removed from said brace by lifting.

4. A combination of a container and an elongate member according to claim 1, wherein said lines of weakness or cuts are dimensioned such that in a first orientation of said container said pocket cannot support said brace cannot hold said elongate member against the force of gravity.

5. A combination of a container and an elongate member according to claim 1, wherein a first line of weakness or cuts of said plurality of lines of weakness or cuts is positioned adjacent a first end of said side panel, the container being closed at said first end, such that said pocket is formed (i) if said first line of weakness or cut is a line of weakness by breaking said side panel along said first line of weakness, in either case (ii) bending said side panel between said first line of weakness or cut and said first end outwards and generally perpendicularly to said first line of weakness or cut, and (iii) by bending inwardly the side panel on the other side of said first line of weakness generally perpendicularly to said first line of weakness or cut.

6. A combination of a container and an elongate member according to claim 5, wherein said side panel has creases between said first line of weakness or cut and said first end, said creases providing areas with less resistance to bending of said side panel.

7. A combination of a container and an elongate member according to claim 5, wherein said first line of weakness or cut includes a tab shaped portion for aiding a user of said container to break said side panel along said first line of weakness or cut and to bend said side panel outwards between said first line of weakness or cut and said first end.

8. A combination of a container and an elongate member according to claim 1, wherein a second line of weakness or cut of said plurality of lines of weakness or cuts is positioned adjacent a second end of said side panel, such that said brace is formed by (i) if said second line of weakness or cut is a line of weakness breaking said side panel at said second line of weakness, in either case (ii) bending said panel on the side of the second line of weakness or cut closest to said second end generally perpendicularly to said second line of weakness or cut outwards, and (iii) by bending inwardly said side panel on the other side of said second line of weakness or cut generally perpendicularly to said second line of weakness or cut, thereby forming a strip for partly surrounding a medial portion of said elongate member.

9. A combination of a container and an elongate member according to claim 8, wherein a third line of weakness or cut of said plurality of lines of weakness or cuts is positioned between said second line of weakness or cut and said second end and generally parallel to said second line of weakness or cut, whereby to form said brace, (ii) if said third line of weakness or cut is a line of weakness said third line of weakness is broken and in either case (ii) said side panel on the side of the third line of weakness or cut closest to said second end is bent inwards generally perpendicularly to said third line of weakness or cut.

10. A combination of a container and an elongate member according to claim 1, wherein said side panel comprises a crease generally perpendicular to said lines of weakness or cuts and central of said side panel providing an area of less resistance to bending.

11. A combination of a container and an elongate member according to claim 5, wherein said second line of weakness or cut includes a tab shape for aiding a user of said container to bend said side panel.

12. A combination of a container and an elongate member according to claim 6, wherein said third line of weakness or cut includes a tab shape for aiding a user of said container to bend said side panel.

13. A combination of a container and an elongate member according to claim 1, wherein if said plurality of lines of weakness or cuts are a plurality of lines of weakness, they comprise perforations in said side panel.

14. A combination of a container and an elongate member according to claim 1, wherein if said plurality of lines of weakness or cuts are a plurality of lines of weakness, they comprise scored lines in said side panel.

15. A combination of a container and an elongate member according to claim 1, wherein said plurality of lines of weakness or cuts are generally parallel to one another.

16. A combination of a container and an elongate member according to claim 1, wherein said elongate member is a toiletry product.

17. A combination of a container and an elongate member according to claim 1, wherein said elongate member is an elongate handle of a razor.

18. A combination of a container and an elongate member according to claim 1, wherein said elongate member is a toothbrush.

19. A combination of a container and an elongate member according to claim 1, wherein at least one toiletry product is housed in said container.

20. A combination of a container and an elongate member according to claim 1, wherein said container and said lines of weakness or cuts are further dimensioned such that when said brace and pocket are formed, an end of said elongate member can be supported in said pocket and, in at least one position, said brace and side panel surround said elongate member without being in contact with said elongate member.

21. A combination of a container and an elongate member according claim 1, to herein said plurality of lines of weakness or cuts extend across the entire width of said side panel.

22. A combination of a container and a razor, said razor comprising an elongate handle and a head and said container including a side panel with an inner face and an outer face and with at least three substantially parallel lines of weakness or cuts for enabling a first brace and a second brace to be formed, said container and said lines of weakness or cuts being dimensioned such that when formed, said first brace supports said razor by said head and said first and second braces loosely hold said elongate handle at medial portions thereof thereby to locate said razor relative to said container and such that said razor is located adjacent said inner face at the medial portion and adjacent the outer face on either side of the medial portion and such that said razor can easily be removed from said first and second brace with one hand.

* * * * *